US006289185B1

(12) United States Patent
Cahill

(10) Patent No.: US 6,289,185 B1
(45) Date of Patent: Sep. 11, 2001

(54) SYSTEM FOR CONTROLLING AXIAL TEMPERATURE UNIFORMITY IN A REPRODUCTION APPARATUS FUSER

(76) Inventor: David F. Cahill, 1447 St. Paul St., Rochester, NY (US) 14653-7001

( * ) Notice: Subject to any disclaimer, the term of this patent is extended or adjusted under 35 U.S.C. 154(b) by 0 days.

(21) Appl. No.: 09/573,910

(22) Filed: May 18, 2000

(51) Int. Cl.[7] ..... G03G 15/20

(52) U.S. Cl. ..... 399/69; 399/45; 399/82; 399/334

(58) Field of Search ..... 399/69, 67, 334, 399/328, 45, 82; 219/216, 470; 430/99, 124; 432/60; 118/60

(56) References Cited

U.S. PATENT DOCUMENTS 4,009,953 * 3/1977 Ravizza et al. ..... 399/334
4,549,803 * 10/1985 Ohno et al. ..... 399/45
4,801,968 * 1/1989 Kogure et al. ..... 399/334
5,708,949 * 1/1998 Kasahara et al. ..... 219/216 X
6,011,939 * 1/2000 Martin ..... 399/69

FOREIGN PATENT DOCUMENTS 62-287277 * 12/1987 (JP) .
8-123230 * 5/1996 (JP) .

* cited by examiner

*Primary Examiner*—Sophia S. Chen

(57) ABSTRACT

A system for controlling axial temperature uniformity in a reproduction apparatus fuser device having at least one heated fuser member to permanently fix a marking particle image to a receiver member which may be of any of a variety of widths. The axial temperature uniformity control system includes a fuser member heater having at least one elongated heater lamp capable of exhibiting differing effective heating lengths. A logic and control unit is then provided to control the operation of said heater lamp to provide respective different effective heating lengths for different discrete modes of operation.

13 Claims, 2 Drawing Sheets

SYSTEM FOR CONTROLLING AXIAL TEMPERATURE UNIFORMITY IN A REPRODUCTION APPARATUS FUSER

FIELD OF THE INVENTION

This invention relates in general to a fuser in general to a fuser mechanism for a reproduction apparatus, and more particularly to a system for controlling axial temperature uniformity in a reproduction apparatus fuser.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of receiver member, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser device for typical electrographic reproduction apparatus includes at least one heated roller, having an aluminum core and an elastomeric cover layer, and at least one pressure roller in nip relation with the heated roller. The fuser device rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member.

Accordingly, upon cooling, the marking particle image is permanently fixed to the receiver member.

Most commercial electrographic reproduction apparatus are capable of reproducing images on receiver members of a range of widths, for example ranging from 8" to over 14". The fuser device therefore must heat any of these different width receiver members to the proper temperature range for good fusing. As a receiver member passes over the fuser roller, it absorbs and carries heat away from the roller. When the receiver member is narrower than the width of the fuser roller, the fuser roller heat is not removed from the roller in the areas beyond the receiver member width.

Typical fuser devices use a single lamp where the filament lengths are equal to or greater than the widest receiver member run in the reproduction apparatus. This produces a fairly uniform temperature distribution when the reproduction apparatus is making wide copies. However, when making narrower copies, excess heat beyond the receiver member edges causes the ends of the fuser roller temperature to rise.

Axial temperature uniformity along the fuser roller affects how well marking particles are fixed to the receiver member, receiver member handling performance, and fuser roller life. If there is non-uniform temperature on the fuser roller surface, the fixing quality on the receiver member will also be non-uniform. Further, fusing temperature affects fixing quality by how well the marking particles are melted and imbibed into the receiver member. Temperature uniformity affects fusing receiver member handling performance. A nip is formed between the fuser and pressure roller, the shape of which is predetermined to improve wrinkle performance. Any deviations from this shape can lessen the intended performance. The aluminum cores and elastomeric covers of the fuser rollers generally have high coefficients of thermal expansion. If the temperature is non-uniform, the thermal expansion of the rollers will be non-uniform and affect the nip shape accordingly. Accordingly, degradation of receiver member handling will result. Moreover, excessive fuser roller temperatures cause elastomeric covers to degrade causing loss of release characteristics and excessive hardening.

SUMMARY OF THE INVENTION

In view of the above, this invention is directed to a system for controlling axial temperature uniformity in a reproduction apparatus fuser having at least one heated fuser member to permanently fix a marking particle image to a receiver member which may be of any of a variety of widths. The axial temperature uniformity control system includes a fuser member heater having at least one elongated heater lamp capable of exhibiting differing effective heating lengths. A logic and control unit is then provided to control the operation of said heater lamp to provide respective different effective heating lengths for different discrete modes of operation.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
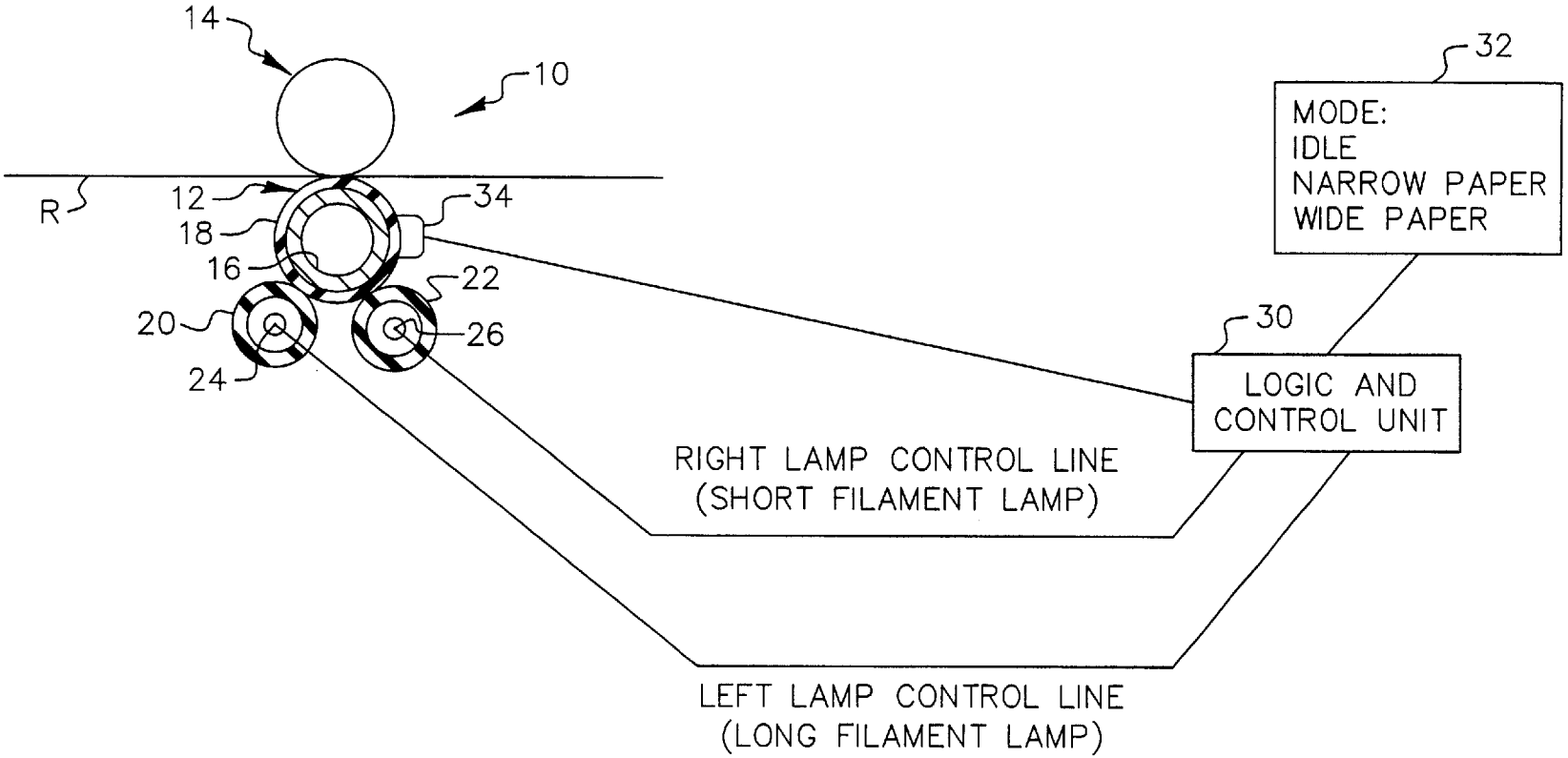
FIG. 1 is a generally schematic illustration of a reproduction apparatus fuser and the system for controlling axial temperature uniformity thereof according to this invention.
Figure 2A:
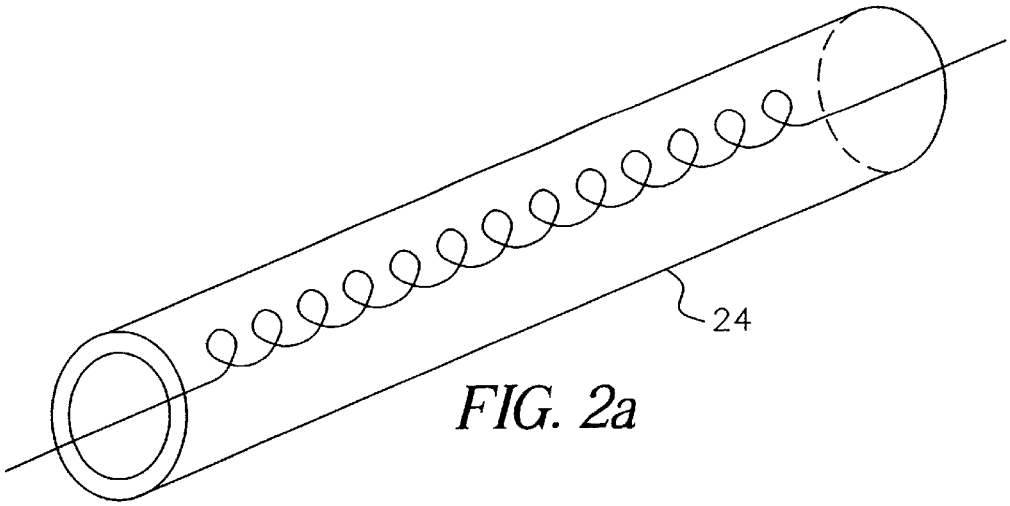
FIGS. 2*a* and 2*b* are schematic views, in perspective of heater lamps, respectively with a long filament and a short filament.
Figure 2B:
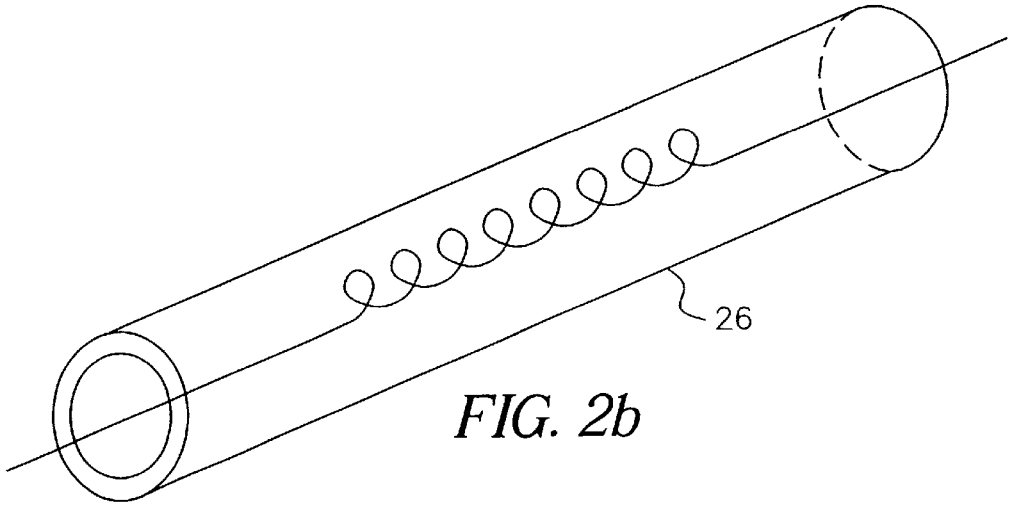

Referring now to the accompanying drawings, FIG. 1 shows a typical fuser device, designated generally by the numeral 10, for a reproduction apparatus. The fuser device 10 includes an elongated heated fuser roller 12 in nip relation with a pressure roller 14. Rotation of the fuser rollers by any suitable drive mechanism (not shown) will serve to transport a receiver member (designated by the letter R), bearing a marking particle image through the nip in the indicated direction under the application of heat and pressure. The receiver member may be, for example, a sheet of plain bond receiver member, or transparency material, and may be of any width, for example between 8" to over 14". The heat will soften the marking particles and the pressure will force the particles into intimate contact to be at least partially imbibed into the fibers at the surface of the receiver material. Thus, when the marking particles cool, they are permanently fixed to the receiver member in an image-wise fashion.

The elongated fuser roller 12 includes a core 16, for example made of aluminum, and a cylindrical fusing blanket 18 supported on the core. The blanket 18 is typically made of a elastomeric material such as rubber particularly formulated to be heat conductive or heat insulative dependent upon whether the fuser heat source is located within the core 16 or in juxtaposition with the periphery of the blanket. A well known suitable surface coating (not shown) may be applied to the blanket 18 to substantially prevent offsetting of the marking particle image to the fuser roller 12. In the illustrated preferred embodiment as shown in the FIG., the heat source for the fuser roller 12 is a pair of external heater rollers, respectively designated by the numerals 20, 22, having internal heater lamps 24, 26. The fuser roller is cradled between the two heater rollers 20, 22, and heat is applied to the fuser roller from the internally heated heater rollers.

The pressure load on the elongated fuser roller 12 is applied by the pressure roller 14. The pressure roller 14 has a bard outer shell. Typically, the shell is made of metal, such as aluminum or steel for example. The shell may also have a well known suitable surface coating (not shown) applied thereto to substantially prevent offsetting of the marking particle image to the pressure roller 14. A cleaning assembly (not shown) may be provided to remove residual marking particle, receiver member fibers, and dust from the fuser apparatus rollers.

According to this invention, a control system is provided for controlling axial temperature uniformity in a reproduction apparatus fuser device. While, the control system is described with respect to the shown externally heated fuser device 10, it is suitable for application to other fuser devices, such as an internally heated fuser. Particularly, a different heater lamp is used inside each heater roller. That is, the heater roller first to contact the fuser roller 12 in the direction of rotation thereof (i.e., heater roller 22) has a heater lamp 26 with a short filament length roughly equal to the width of narrowest receiver member required to be fused by the fuser device 10. The heater roller second to contact the fuser roller 12 in the direction of rotation thereof (i.e., heater roller 20) has a heater lamp 24 with a full-length filament exhibiting uniform power flux density in the central section and a higher flux density at the lamp ends. Both lamps are individually controlled by a microprocessor based logic and control unit 30, depending on where heat is required.

The logic and control unit 30 is programmed to control the operation of the lamps 20, 22 differently for three different discrete modes of operation, i.e., idle mode (not making copies), narrow receiver member mode, and wide receiver member mode. An indicator 32 is provided to send a signal to the logic and control unit 30 to indicate to the unit which discrete mode of operation is required for the fuser device 10.

For idle mode operation, there is no receiver member taking away heat from the fuser roller 12, and the fuser roller requires relatively little heat to maintain a "ready" temperature. In this mode of operation, the loss of heat through the ends and/or bearings of the roller is significant compared to the loss of heat from the rest of the roller. Therefore, it is necessary to supply more heat at the ends of the roller. Accordingly, the logic and control unit 30 turns on the full-length filament of the lamp 24 of the heater roller 20 a higher percentage of time than the short filament lamp 26 of the heater roller 22 to supply more heat to the ends of the fuser roller 12.

In narrow receiver member mode operation, the short filament lamp 26 of the heater roller 22 is turned on a higher percentage of time than the full-length filament of the lamp 24 of the heater roller 20. This prevents the ends of the fuser roller 12 from becoming hotter than the center. In the wide receiver member mode, the on-time percentage of the lamps 24, 26, is set to optimize the temperature uniformity along the axial length of the fuser roller.

The actual magnitude of time that each of the lamps 24, 26 are used in each discrete mode of operation depends upon the length and heat flux shape of the long and short filament lamps. The filament lengths and flux shapes, along with the power on time scaling percentages, for each lamp was developed to produce a uniform temperature profile for all modes of operation.

The centerline surface temperature of the fuser roller 12 is used for the basis of the temperature control by the logic and control unit 30. Such centerline surface temperature, as measured by a temperature control sensor 34, is used to provide a feedback signal to the logic and control unit. Any suitable detector (not shown) at the receiver member input trays of the reproduction apparatus is used to determine the length (perpendicular to process direction) of receiver members upon which marking particle images are to be fused by the fuser device 10. The detector provides a signal to the indictor 32 to establish which mode of operation is required by the fuser device. The logic and control unit 30 uses the feedback from such detector, through the indicator 32, to adjust the output power to the lamps 24, 26 to maintain the desired temperature of the fuser roller 12 of the fuser device, depending upon the operation mode. Once the general output is determined, the on-time scaling percentages are applied according to the required operation mode—idle, narrow, or wide receiver member.

Figure 3:
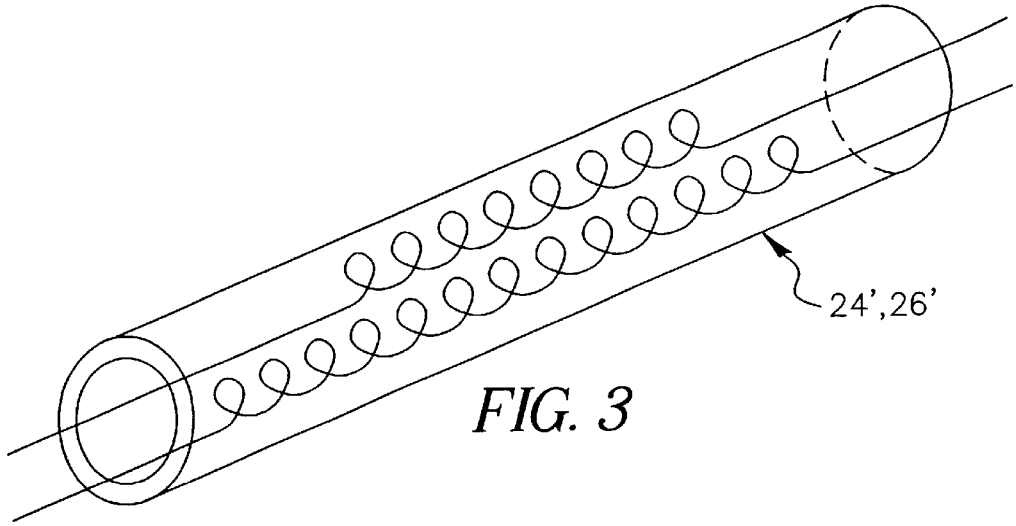
FIG. 3 is a schematic view, in perspective of an alternate embodiment of a heater lamp with both long and short filaments.

The lamp filament combinations may be changed in any number of configurations to tune the temperature zones for the particular fuser roller. One such change would be to configure the short filament lamp with a full-length filament (see FIG. 3) that supplies some heat outside the narrow receiver member path, but less than the standard heat, which is supplied to the center section. Further, more than one temperature sensor could be used. The above system uses an algorithm based on experience and testing to proportion the lamps according to the receiver member widths. If more precise control was desired, a second temperature sensor could be placed at the outboard ends of the fuser roller to monitor the actual temperature at such outboard ends and adjust the lamp usage accordingly.

For even more accuracy, with a larger variety of receiver member widths, additional lamps with different filaments could be used, or multiple lamps could be used inside each heater roller. Additional specially sized heater rollers may be used as well as various engagement mechanisms. These mechanisms would selectively engage the special heater rollers on demand for special heating applications such as droop recovery or special receiver member widths. Of course, any of the above two filaments, customized power flux profiles, with variable power on percentages, could also be applied to an internally heated fuser or pressure roll.

The invention has been described in detail with particular reference to certain preferred embodiments thereof, but it will be understood that variations and modifications can be effected within the spirit and scope of the invention.

What is claimed is:

1. A system for controlling axial temperature uniformity in a reproduction apparatus fuser device having at least one heated fuser member to permanently fix a marking particle image to a receiver member which may be of any of a variety of widths, said axial temperature uniformity control system comprising:

a fuser member heater having at least one elongated heater lamp capable of exhibiting differing effective heating lengths; and a logic and control unit to control the operation of said heater lamp to provide respective different effective heating lengths for different discrete modes of operation dependent, at least in part, upon receiver member widths, said logic and control unit including an indicator to provide a signal for said logic and control unit to indicate which mode of operation is required for the fuser device.

2. The axial temperature uniformity control system according to claim 1 wherein said at least one elongated heater lamp has a short filament length, roughly equal to the width of narrowest receiver member required to be fused by said fuser device, and a full-length filament.

3. The axial temperature uniformity control system according to claim 2 wherein said indicator indicates different discrete modes of operation including idle mode, narrow receiver member mode, and wide receiver member mode.

4. The axial temperature uniformity control system according to claim 2 wherein said indicator indicates different discrete modes of operation including idle mode where no receiver member is being fused and takes away heat from the fuser member and the fuser member requires relatively little heat to maintain a "ready" temperature, and said logic and control unit turns on said full-length filament a higher percentage of time than said short filament to supply more heat to the ends of the fuser member; a narrow receiver member mode where said logic and control unit turns on said short filament a higher percentage of time than said full-length filament to prevent the ends of said fuser member from becoming hotter than the center; and wide receiver member mode where on-time percentage of said filaments by said logic and control unit is set to optimize the temperature uniformity along the axial length of said fuser member.

5. The axial temperature uniformity control system according to claim 1 wherein said fuser member heater includes a pair of heater lamps, one of said pair of heater lamps having a short filament length roughly equal to the width of narrowest receiver member required to be fused by said fuser device, and the second of said pair of heater lamps having a full-length filament.

6. The axial temperature uniformity control system according to claim 5 wherein said indicator indicates different discrete modes of operation including idle mode where no receiver member is being fused and takes away heat from the fuser member and the fuser member requires relatively little heat to maintain a "ready" temperature, and said logic and control unit turns on said heater lamp with said full-length filament a higher percentage of time than said heater lamp with said short filament to supply more heat to the ends of the fuser member; a narrow receiver member mode where said logic and control unit turns on said heater lamp with said short filament a higher percentage of time than said heater lamp with said full-length filament to prevent the ends of said fuser member from becoming hotter than the center; and wide receiver member mode where on-time percentage of said heater lamp with said full-length and said short filaments by said logic and control unit is set to optimize the temperature uniformity along the axial length of said fuser member.

7. The axial temperature uniformity control system according to claim 1 further including a sensor for measuring a centerline surface temperature of said fuser member and producing a signal corresponding thereto, and wherein said signal from said sensor, representing such centerline surface temperature of said fuser member, is used to provide a feedback signal to said logic and control unit.

8. A system for controlling axial temperature uniformity in a reproduction apparatus fuser device having at least one elongated heated fuser roller to permanently fix a marking particle image to a receiver member which may be of any of a variety of widths, said axial temperature uniformity control system comprising:

a fuser roller heater having at least one elongated heater roller engaging the external surface of said fuser roller, said heater roller having a lamp internal thereto, said lamp capable of exhibiting differing effective heating lengths; and a logic and control unit to control the operation of said heater lamp to provide respective different effective heating lengths for different discrete modes of operation dependent, at least in part, upon receiver member widths, said logic and control unit including an indicator is provided to send a signal to said logic and control unit to indicate which mode of operation is required for the fuser device.

9. The axial temperature uniformity control system according to claim 8 wherein said at least one elongated heater lamp has a short filament length, roughly equal to the width of narrowest receiver member required to be fused by said fuser device, and a full-length filament.

10. The axial temperature uniformity control system according to claim 8 wherein said fuser member heater includes a pair of heater rollers engaging the external surface of said fuser roller, each of said heater rollers respectively having a lamp internal thereto, one of said pair of heater roller lamps having a short filament length roughly equal to the width of narrowest receiver member required to be fused by said fuser device, and the second of said pair of heater roller lamps having a full-length filament.

11. The axial temperature uniformity control system according to claim 8 wherein said fuser member heater includes a pair of heater rollers, said heater roller of said pair of heater rollers first to contact said fuser roller in the direction of rotation thereof has a heater lamp with a short filament length roughly equal to the width of narrowest receiver member required to be fused by said fuser device, and said heater roller second to contact said fuser roller in the direction of rotation thereof has a heater lamp with a full-length filament exhibiting uniform power flux density in the central section and a higher flux density at the lamp ends.

12. The axial temperature uniformity control system according to claim 11 wherein said indicator indicates different discrete modes of operation including idle mode where no receiver member is being fused and takes away heat from said fuser roller and the fuser roller requires relatively little heat to maintain a "ready" temperature, and said logic and control unit turns on said heater lamp with said full length filament a higher percentage of time than said heater lamp with said short filament to supply more heat to the ends of the fuser roller; a narrow receiver member mode where said logic and control unit turns on said heater lamp with said short filament a higher percentage of time than said heater lamp with said full-length filament to prevent the ends of said fuser roller from becoming hotter than the center; and wide receiver member mode where on-time percentage of said heater lamp with said full-length and short filaments by said logic and control unit is set to optimize the temperature uniformity along the axial length of said fuser member.

13. The axial temperature uniformity control system according to claim 8 further including a sensor for measuring a centerline surface temperature of said fuser member and producing a signal corresponding thereto, and wherein said signal from said sensor, representing such centerline surface temperature of said fuser member, is used to provide a feedback signal to said logic and control unit.

* * * * *